United States Patent [19]

Dubost et al.

[11] 4,005,430

[45] Jan. 25, 1977

[54] THICK FOLDED DIPOLE WHICH IS TUNEABLE WITHIN A FREQUENCY BAND OF TWO OCTAVES

[75] Inventors: Gerard Dubost, Briand Rennes; Henri Albert Havot, Cesson-Sevigne, both of France

[73] Assignee: Etat Francais represente par le Delegue Ministeriel pour l'Armement, France

[22] Filed: Jan. 12, 1976

[21] Appl. No.: 648,290

[30] Foreign Application Priority Data

Jan. 17, 1975 France ..... 75.01379

[52] U.S. Cl. ..... 343/747; 343/803; 343/807; 343/845

[51] Int. Cl.[2] ..... H01Q 9/26

[58] Field of Search ..... 343/745, 747, 752, 803, 343/804, 807, 845

[56] References Cited

UNITED STATES PATENTS 2,994,876 8/1961 Josephson ..... 343/845

*Primary Examiner*—Eli Lieberman

*Attorney, Agent, or Firm*—Stevens, Davis, Miller & Mosher

[57] ABSTRACT

A thick folded dipole having an operating frequency which is far less than the first resonance frequency. The dipole includes a folded strand and a thick fed strand having a diameter which is about ten times greater than the diameter of the folded strand. The fed strand comprises two spaced apart cylindrical half strands having ends in the form of conical frustums and coaxial bore holes. A center conductor of a coaxial cable extends through the folded strand, the bore hole of one half strand, the space between the half strands and into the bore hole of the other half strand. Symmetrical spaced apart short circuits for matching the radiation impedance of the dipole by varying the distance between the short circuits are provided between the fed strand and the folded strand. In another embodiment there is disclosed a thick folded half dipole including a folded half strand and a thick fed cylindrical half strand.

9 Claims, 5 Drawing Figures

THICK FOLDED DIPOLE WHICH IS TUNEABLE WITHIN A FREQUENCY BAND OF TWO OCTAVES

The present invention relates to a thick folded dipole which is relatively short as compared with the wavelength and can be tuned within a frequency band of two octaves with excellent efficiency.

In the French Patent Application filed on May 21, 1973 in the names of Gerard Dubost and Henri Havot under National Registration No. 73 19255 entitled "System of folded dipoles" there has already been described a network of thick folded dipoles in which each thick folded dipole has broad pass-band properties for frequencies definitely higher than the frequency of the first resonance, the diameter of the fed strand of the dipole being about ten times greater than the diameter of the folded strand and about one-tenth the wavelength in space corresponding to the upper frequency of the pass band.

In the French Patent Application filed on July 18, 1974 in the name of the French State (inventors: Gerard Dubost and Henri Havot) under National Registration No. 74 24951 entitled "Shortened thick folded dipole" there has already been described a dipole capable of operating at frequencies below the frequency of the first resonance within a relatively wide frequency band. In this dipole, the fed strand comprises two cylindrical half-strands terminating in two opposite conical frustums, the small bases of which are close to each other, one of the half strands being traversed axially by a coaxial line having, preferably, a nominal impedance close to 50 ohms, the central conductor of the line being extended towards the other half strand passing through the free space present between the small bases of the conical frustums and penetrating coaxially into the other half strand from which it is insulated. In this way there is produced a capacitance in series with the impedance of the dipole, which makes it possible to compensate for the impedance.

One object of the present invention is to provide a thick folded dipole of the above type which is capable, by combining the advantages of the dipoles already described, of operating within a frequency band of two octaves. Such a dipole can then advantageously be substituted for the conventional whip of reduced dimensions, the matching of the input impedance of which is effected only with poor efficiency by means of a tuning box arranged at the base of the antenna.

In accordance with one feature of the invention, a thick folded dipole is provided, the diameter of the fed strand of which is about ten times greater than that of the folded strand, the fed strand comprising two symmetrical cylindrical half strands having ends in the shape of conical frustums, one of the half strands being traversed by the coaxial line carrying the signals to be emitted or to be received, the central conductor of the coaxial line being extended through the free space between the two half strands in order to penetrate coaxially into a bore hole in the other half strand, and symmetrical short circuits being provided between the fed thick strand and the folded strand in order to permit a matching of the radiation impedance of the dipole by varying the distance between the short circuits.

In accordance with another feature, the end of the coaxial line penetrating into the other half strand is connected to the latter by a variable capacitance.

In accordance with another feature, the variable capacitance consists of a dielectric sleeve placed to a greater or lesser extent over the end of the coaxial line.

In accordance with another feature, the end of the coaxial line penetrating into the other half strand is connected to the latter by a variable inductance.

In accordance with another feature, a movable contact is provided in the other half strand between the end of the coaxial line and, on the one hand, the variable capacitance or, on the other hand, the variable inductance.

In accordance with another feature, a thick folded half dipole is also provided in front of a reflector plane formed of the flat surface of a conductive metal plate perpendicular to the longitudinal axis of the half dipole, the central conductor of the coaxial line of the half dipole passing through an axial orifice of the plate and being connected to the ground thereof by a variable capacitance or a variable inductance.

Other features of the present invention will become clearer from a reading of the following description of illustrative embodiments, the description being given in connection with the accompanying drawings, in which.

Figure 1:
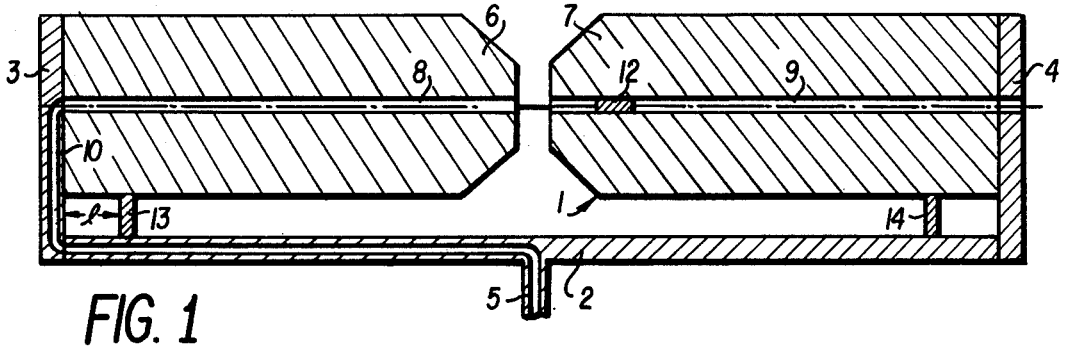
FIG. 1 is a view in longitudinal section through a thick folded dipole in accordance with the invention.

The folded dipole of FIG. 1 comprises, as in the two patent applications described above, a fed or excited strand 1 and a folded strand 2. The two strands 1 and 2 are rigidly held together by cheeks 3 and 4 of conductive material like the strands. The strand 2 is a cylinder welded at its center to a rigid cylindrical support 5 which is perpendicular to the strand 2.

As already stated, the strand 1 is the excited strand and comprises two separate half strands, the left half strand 6 and the right half strand 7. The parts 6 and 7 terminate at the center in two symmetrical opposite conical frustums, the small bases of which face each other, the rest of strands 6 and 7 being cylindrical and of the same diameter as the large bases of the cone frustums. In practice, the bodies of strands 6 and 7 may be solid, the body of strand 6 having a bore hole 8 and the body of strand 7 having a bore hole 9, these two bore holes being coaxial. The bore hole 8 has a diameter close to the diameter of the coaxial cable 10 which is introduced into hole 8 after having passed through the cheek 3, the strand 2 and the support 5 to terminate at a transmitter-receiver, not shown. The cable 10 preferably has a characteristic impedance of 50 ohms. The bore hole 9 has a diameter substantially equal to the inside diameter of the cable 10. The center conductor 11 of coaxial cable 10 is extended between the two conical frustums and penetrates into the bore hole 9 of strand 7 over a predetermined length. Into the bore hole 9 there is introduced a small sleeve 12 of dielectric material which is placed to a greater or lesser extent over the conductor 11 so as to vary the capacitance, thus produced, in series with the impedance of radiation of the dipole, this arrangement having already been described in the aforementioned application No. 74 24951.

A short circuit 13 is arranged between the strand 2 and the half strand 6 while a short circuit 14 is arranged between the strand 2 and the half strand 7. The short circuits 13 and 14 are placed, respectively, at the same distance from the cheeks 3 and 4, that is to say positioned symmetrically with respect to the middle of the dipole. As shown in FIG. 1, they can be formed of small blocks of a metal of good conductivity, which blocks have concave opposite faces with radii of curvature enabling them to follow the shapes of the strands of the dipole. They may also each be formed of a switch diode which forms part of a network of diodes mounted between the strands.

Experience has shown that by moving the short circuits 13 and 14 on the one hand and the sleeve 12 on the other hand, it was possible to match the radiation impedance of the dipole with that of the coaxial 10 within a broad frequency band below the frequency of the first resonance. When displacing short circuits 13 and 14 care is had to maintain their symmetrical positions with respect to the center of the dipole. Somewhat further on in the present description, an illustrative embodiment with values will be mentioned.

Figure 2:
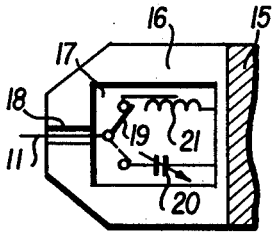
FIG. 2 is a partial sectional view showing the arrangement of a variable capacitance and a variable inductance within a half strand.

FIG. 2 shows another embodiment of the half strand 7 formed of a cylinder 15 extended by two half shells 16 having between them a cavity 17 and a hole 18 of the same diameter as hole 9 through which the conductor 11 passes. The end of center conductor 11 is connected electrically to a reversing switch 19, a stationary contact of which is connected to an electrode of a variable capacitor 20, its second electrode being connected to the ground of strand 7, and the other stationary contact of which is connected to the slider of a variable inductance 21 having one terminal also connected to the ground of strand 7.

When the contact 19 places the capacitor 20 in the circuit, one can have the same operation as in FIG. 1, that is to say, by acting on capacitor 20 and on the short circuits 13 and 14 the dipole can be adapted below the frequency of the first resonance.

The inductance 21 is provided for operation above the frequency of the first resonance, the two short circuits 13 and 14 being placed against the cheeks 3 and 4 in order to give the dipole its total length, the inductance being then in series with the radiation impedance of the dipole.

Experience has shown that matching of the dipole above the frequency of the first resonance could be effected, with the inductance 21, within a wide frequency band which — which is remarkable — intersects in its lower portion the frequency band useable below the frequency of the first resonance when using the variable capacitor 20. In general, the value of the inductance decreases when the frequency increases.

Figure 3:
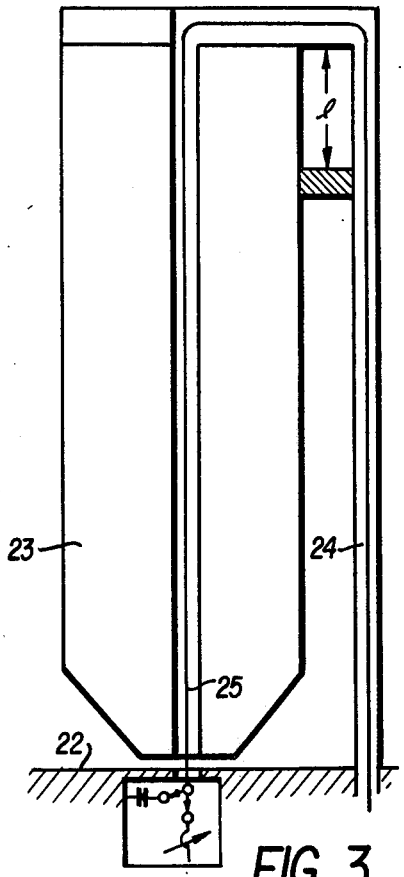
FIG. 3 is a longitudinal sectional view of a thick folded half dipole in accordance with the invention.

FIG. 3 shows another embodiment formed of a half dipole above a reflector plane 22 formed of the upper face of a conductive plate. This half dipole is shown schematically and comprises a thick half strand 23 and a folded half strand 24. The half strand 23 is insulated from the plate 22, its distance being practically equal to one half of the free space between strands 6 and 7 of FIG. 1. A coaxial cable passes successively into strands 24 and 23 and has its central conductor 25 extended beyond strand 23 to enter into a small hole of the plate 22 within which there is contained a reversing switch which can place a variable capacitor or an inductor into the circuit, as shown in FIG. 2. The operation of the dipole of FIG. 3 is substantially the same as that of the dipoles of FIGS. 1 and 2. It will be noted that for most of its height, the strand 23 is divided by two.

Figure 4:
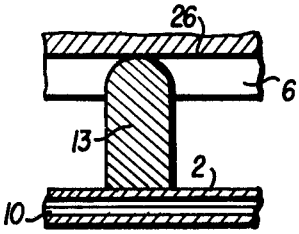
FIG. 4 is a partial sectional view of a short circuit in accordance with the invention.

By way of example, FIG. 4 shows another mechanical embodiment of a short circuit, such as circuit 13. It slides with soft friction in a slot of the body of strand 6 within which it comes into contact with the bottom of the groove, the top of short circuit 13 being slightly convex, which facilitates its displacement. A spring may furthermore be provided between circuit 13 and the bottom 26 of the groove.

Figure 5:
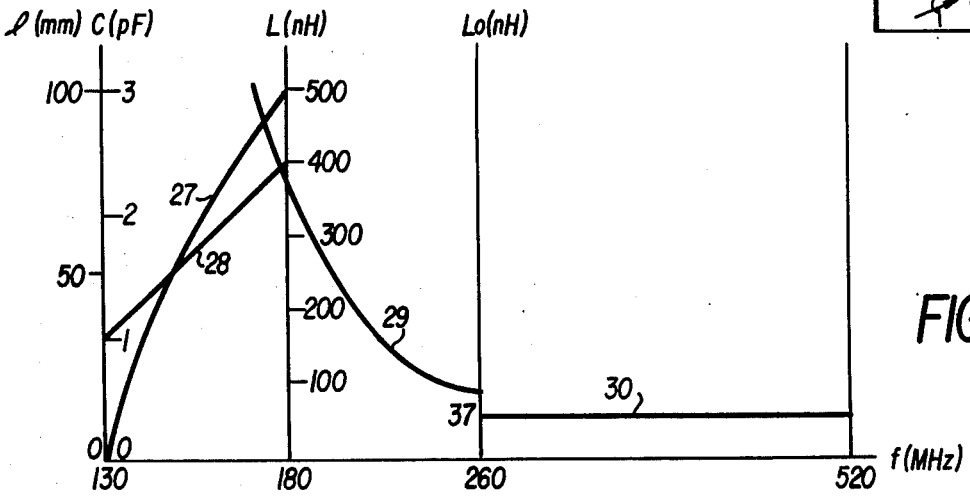
FIG. 5 shows the adjustment curves of the variable components of the dipole as a function of the operating frequency of the latter.

FIG. 5 illustrates the variations of the various components of the dipole of the invention, making it possible to operate it between 130 and 520 megacycles, that is to say over two octaves under very good conditions of matching. The dimensions of the dipole of FIG. 1 which make it possible to cover this particular band are as follows:

| | |
|---|---|
| Total length | 360. mm |
| Diameter of the excited strand | 57.6 mm |
| Diameter of the folded strand | 7.2 mm |
| Distance between the center lines of the strands | 43.2 mm |
| Angle at the apex of the conical frustums | 80° |

In FIG. 5 there will be considered three frequency ranges which intersect, the first extending from 130 to 180 megacycles, the second from 170 to 260 megacycles and the third from 260 to 520 megacycles, as shown by the numbers entered on the abscissa.

With respect to the first low range, the ordinate axis bears on the one hand the values of variations of L, that is to say the distance between the short circuits and their respective cheeks which is variable from 0 to 100 mm and, on the other hand, the values of variations of C, that is to say the capacitance of sleeve 12 or capacitor 20, variable between about 1 and 3 pF. The variation curve 27 of L and the variation curve 28 of C, both as a function of the frequency, give the values to be attributed to these two variables in order to obtain at each frequency of the range a standing wave ratio (SWR) equal to 1.05, that is to say an excellent match. It should furthermore be noted that at each frequency, once the values of L and of C have been determined in accordance with curves 27 and 28, the width of the frequency band for which the SWR is less than or equal to 2 varies by 1 to 4 megacycles, practically linearly, from 130 to 180 megacycles. This property indicates that the position of the short circuits is not critical and that a precision of the order of a millimeter is more than sufficient.

As a variant, if one assumes as acceptable a maximum SWR of 1.6 throughout the entire range, it is possible to use a capacitance of fixed value substantially equal to 1.65 pF for capacitor 20, only the position of the short circuits remaining variable. The variation curve of L is still close to the curve 27. Through the entire range, the band width of the frequencies for which the SWR remains less than or equal to 2 varies from 1 to 2 megacycles. The position of the short circuits is therefore not always critical.

With respect to the average range, the axis of the ordinates bears the values of variations of the inductance L′ of inductor 21 of FIG. 2. The curve 29 indicates the values to be given to L′ as a function of the frequency in order to obtain, upon tuning, an SWR which is always less than 2 throughout the entire range. The inductance being adjusted, the band width for an SWR less than or equal to 2 varies from 5 to 20 megacycles between 180 and 260 megacycles in a nonlinear manner. The tuning of the self inductance is therefore not critical.

With respect to the high range, the dipole is no longer tuneable. It has the wide band properties already described. Its matching is preferably effected by means of a fixed self-inductance $L_o'$ in series which may very simply be the residual self-inductance of inductor 21, selected from the order of 37nH.

It should be noted that in the medium and high ranges, the short circuits 13 and 14 are obviously applied against cheeks 3 and 4, that is to say $L = 0$. The dipole has its initial length.

By way of example it can furthermore be indicated that the half dipole of FIG. 3 is tuneable from 20 to 80 megacycles by means of a fixed capacitor and a variable self-inductance by imparting it to the following dimensions:

| | |
|---|---|
| Height of strand 23 | 1,200 mm |
| Diameter of strand 23 | 386 mm |
| Diameter of strand 24 | 40 mm |
| Distance between the center lines of strands 23 and 24 | 290 mm |

With respect to the directional patterns of the dipole of the example of FIG. 1, placed 300 mm in front of a circular reflector of a diameter of 1200 mm, one has respectively the following results:

| | 135 megacycles | 180 megacycles |
|---|---|---|
| Aperture in plane E | 48° | 52° |
| Aperture in plane H | 73° | 74° |
| Directivity | 10.7 db | 10.3 db |
| Secondary lobes | 13 db | 20 dB |

By way of comparison, a half wave conventional dipole placed a quarter wave from a plane has a directivity of 6.8 dB. It therefore appears clearly that the substantial shortening of the thick folded dipole does not take place to the detriment of any property of the dipole, whether it be the band width or the directivity.

Although the principles of the present invention have been described above with reference to specific embodiments, it is to be understood that description has been given merely by way of example and does not limit the scope of the invention.

What is claimed is:

1. A thick folded dipole, comprising:

a. a folded strand having a bore hole;

b. a thick fed strand having a diameter which is about ten times greater than the diameter of said folded strand; said fed strand including two spaced apart symmetrical cylindrical half strands having ends in the form of conical frustums and coaxial bore holes;

c. a coaxial cable for carrying signals to be emitted or received by the dipole, said cable including a center conductor extending through the bore hole of said folded strand, the bore hole of one half strand, the space between said half strands and into the bore hole of the other half strand; and d. symmetrical spaced apart short circuit means for matching the radiation impedance of the dipole by varying the distance between said short circuit means, said means being provided between said fed strand and said folded strand, wherein the operating frequency of the dipole is far less than the first resonance frequency.

2. A thick folded dipole according to claim 1 wherein said other half strand has connected inside of it a fixed capacitance and the end of said center conductor within said other half strand is connected to said other half strand by said fixed capacitance.

3. A thick folded dipole according to claim 1 wherein said other half strand has connected inside of it a variable capacitance, and the end of said center conductor within said other half strand is connected to said other half strand by said variable capacitance.

4. A thick folded dipole according to claim 3 wherein said variable capacitance includes a dielectric sleeve positioned to a greater or lesser extent over said end of said center conductor.

5. A thick folded dipole according to claim 1 wherein said other half strand has connected inside of it a variable inductance, and the end of said center conductor within said other half strand is connected to said other half strand by said inductance.

6. A thick folded dipole according to claim 1 wherein said other half strand has inside of it a switch means having a movable contact and connected to the end of said center conductor within said other half strand, a variable inductance connected to said other half strand, and a variable capacitance connected to said other half strand, said contact being movable to contact either said inductance or said capacitance, whereby said end of said conductor is connected to said other half strand either by said inductance or said capacitance.

7. A thick folded half dipole, comprising:

a. a folded half strand having a first bore hole;

b. a thick fed cylindrical half strand having a diameter which is about ten times greater than the diameter of said folded strand, said cylindrical half strand having an end in the form of a conical frustum and a second bore hole;

c. a ground conductive metallic plate having a flat surface perpendicular to the longitudinal axis of the half dipole, said plate forming a reflector plane and having a third hole;

d. a capacitance within the third hole and connected to said plate;

e. an inductance within the third hole and connected to said plate;

f. a switch means within the third hole and having a movable contact for connection either to said capacitance or said inductance;

g. short circuit means provided between said folded half strand and said cylindrical half strand for matching the radiation impedance of the half dipole by varying the distance between said short circuit means and an end of said cylindrical half strand; and h. a coaxial cable for carrying signals to be emitted or received by the half dipole, said cable including a center conductor extending through the bore holes of said folded half strand and said cylindrical half strand and connected to said switch means, whereby said center conductor is connected to said plate either by said capacitance or said inductance.

8. A thick folded half dipole according to claim 7 wherein said capacitance is variable.

9. A thick folded half dipole according to claim 7 wherein said inductance is variable.

* * * * *